US012241217B2

(12) United States Patent
Karau et al.

(10) Patent No.: US 12,241,217 B2
(45) Date of Patent: Mar. 4, 2025

(54) TAPERED REVETMENT BLOCK WITH LEVELING PADS

(71) Applicant: Contech Engineered Solutions LLC, West Chester, OH (US)

(72) Inventors: William Howard Karau, Southlake, TX (US); Daniel J. Priest, Liberty Township, OH (US)

(73) Assignee: Contech Engineered Solutions LLC, West Chester, OH (US)

( * ) Notice: Subject to any disclaimer, the term of this patent is extended or adjusted under 35 U.S.C. 154(b) by 234 days.

(21) Appl. No.: 17/851,826

(22) Filed: Jun. 28, 2022

(65) Prior Publication Data

US 2023/0010848 A1 Jan. 12, 2023

Related U.S. Application Data

(60) Provisional application No. 63/218,712, filed on Jul. 6, 2021.

(51) Int. Cl.
*E02D 29/02* (2006.01)
*E02B 3/14* (2006.01)

(52) U.S. Cl.
CPC ..... *E02B 3/14* (2013.01)

(58) Field of Classification Search
CPC ..... E02D 29/0233; E02D 29/025; E02D 29/0266; E02D 2200/13; E02D 2300/0006; E02D 2300/0009; E02D 2300/0015; E02D 2300/002; E02D 2300/0029; E02D 2300/0079; E02D 2300/0084; E02D 2600/30; E02D 2600/40; E02D 29/0241; E04B 2002/0213; E04B 2002/0243; E04B 2002/0269; E04B 2/46; E04C 1/395
See application file for complete search history.

(56) References Cited

U.S. PATENT DOCUMENTS 2,344,302 A * 3/1944 Harza ..... E02B 3/14 405/16
2,687,034 A * 8/1954 Blanc ..... E04B 2/18 52/396.08
3,176,468 A * 4/1965 Shoshichiro ..... E02B 3/129 D25/115
3,597,928 A * 8/1971 Pilaar ..... E02B 3/122 405/20

(Continued)

*Primary Examiner* — Edwin J Toledo-Duran
(74) *Attorney, Agent, or Firm* — Dorsey & Whitney LLP

(57) ABSTRACT

A revetment block includes a top surface, a bottom surface, a first pair of parallel, opposing sidewalls extending between the top surface and the bottom surface, and a second pair of parallel, opposing sidewalls extending between the top surface and the bottom surface and each extending between a first sidewall of the first pair of parallel and a second sidewall of the first pair of parallel, opposing sidewalls. The revetment block further includes a horizontal duct extending from the first sidewall to the second sidewall, wherein the horizontal duct is parallel with the bottom surface. The top surface has a non-parallel relationship with the bottom surface, wherein the top surface includes a leveling pad adjacent the first sidewall. The leveling pad is configured to cause a second horizontal duct of a second revetment block stacked on the top surface to be parallel with the first horizontal duct.

28 Claims, 13 Drawing Sheets

(56) References Cited

U.S. PATENT DOCUMENTS 3,846,949 A * 11/1974 Okawa ..... E04B 1/8404 52/145
3,877,236 A * 4/1975 O'Neill ..... E02D 29/0216 52/439
3,996,715 A * 12/1976 Dowse ..... E01C 5/00 52/591.1
4,095,384 A * 6/1978 Zarriello ..... E04B 2/48 428/491
4,175,888 A * 11/1979 Ijima ..... E02B 3/06 405/33
4,186,540 A * 2/1980 Mullins ..... E04B 2/18 D25/116
4,227,829 A * 10/1980 Landry, Jr. ..... E02B 3/14 405/20
4,272,940 A * 6/1981 Nicolls ..... E04B 2/26 52/591.1
4,341,050 A * 7/1982 Long ..... E04B 2/24 52/848
4,370,075 A * 1/1983 Scales ..... E01C 9/004 405/20
4,372,091 A * 2/1983 Brown ..... E04B 2/46 D25/115
4,433,521 A * 2/1984 Dietrich ..... E04C 1/41 52/421
4,512,685 A * 4/1985 Hegle ..... E02D 29/0266 405/262
4,527,373 A * 7/1985 Cruise ..... E04C 1/41 52/405.1
4,564,311 A * 1/1986 Scales ..... E02B 3/14 405/20
4,619,560 A * 10/1986 Crinnion ..... E02B 3/066 52/597
4,698,949 A * 10/1987 Dietrich ..... E04B 2/44 52/603
4,719,735 A * 1/1988 Fleming, Jr. ..... E04C 1/42 D25/103
4,769,964 A * 9/1988 Johnson ..... E04C 1/41 52/444
4,771,583 A * 9/1988 Ball ..... E04B 2/7433 52/239
4,781,492 A * 11/1988 Shindo ..... E02B 3/14 405/20
4,813,812 A * 3/1989 Hasegawa ..... E02B 3/14 405/20
4,819,396 A * 4/1989 Cruise ..... B28B 11/043 52/405.1
4,852,321 A * 8/1989 Fleming, Jr. ..... E04C 1/42 D25/103
4,894,969 A * 1/1990 Horobin ..... E04C 1/40 52/564
4,923,339 A * 5/1990 Smith ..... E02D 29/0216 52/561
4,982,544 A * 1/1991 Smith ..... E02D 29/0241 52/603
4,993,206 A * 2/1991 Pardo ..... E02D 29/025 52/591.4
5,020,938 A * 6/1991 Scales ..... E02B 3/14 405/16
5,044,834 A * 9/1991 Janopaul, Jr. ..... E02D 29/0241 52/169.4
5,064,313 A * 11/1991 Risi ..... E02D 29/0241 405/262
5,108,222 A * 4/1992 Jansson ..... E02B 3/123 D25/138
5,154,542 A * 10/1992 Klenert ..... E02D 29/0216 52/169.4
5,181,362 A * 1/1993 Benitez ..... E04B 2/18 52/591.1
5,218,801 A * 6/1993 Hereford ..... E04B 7/022 52/693
5,257,880 A * 11/1993 Janopaul, Jr. ..... E02D 29/025 52/562
5,277,012 A * 1/1994 Woolbright ..... E02D 29/025 52/591.1
5,282,700 A * 2/1994 Rodrique ..... E02D 29/025 405/286
5,294,216 A * 3/1994 Sievert ..... E04C 1/395 405/262
5,339,592 A * 8/1994 Schmid ..... E04C 1/41 52/309.12
5,350,256 A * 9/1994 Hammer ..... E02D 29/025 405/262
D351,239 S * 10/1994 Klenert ..... D25/113
5,402,609 A * 4/1995 Kelley, Jr. ..... E04B 2/32 52/561
5,456,555 A * 10/1995 Bokeler ..... E02D 29/025 52/562
5,499,891 A * 3/1996 Klenert ..... E02D 29/025 405/262
5,528,873 A * 6/1996 Correia ..... E04B 2/06 405/286
5,537,796 A * 7/1996 Kliethermes, Jr. ..... E04C 1/395 52/592.6
5,544,973 A * 8/1996 Frizell ..... E02B 3/14 405/21
5,551,809 A * 9/1996 Forsberg ..... E02D 29/025 405/285
5,556,228 A * 9/1996 Smith ..... E02B 3/14 405/20
5,619,835 A * 4/1997 Bailey, II ..... E02D 29/0241 405/286
5,632,571 A * 5/1997 Mattox ..... B28B 23/0012 405/20
5,779,391 A * 7/1998 Knight ..... E02B 3/14 405/20
5,823,709 A * 10/1998 Maher ..... E02B 3/122 405/20
5,833,465 A * 11/1998 Jarzewiak ..... G09B 1/36 446/125
5,906,456 A * 5/1999 Knight ..... E02B 3/14 405/20
5,921,710 A * 7/1999 Scales ..... E02B 3/14 405/20
5,971,658 A * 10/1999 Pramono ..... E02B 3/123 405/20
6,000,186 A * 12/1999 Fielding ..... E04B 2/18 52/564
6,071,041 A * 6/2000 Knight ..... E02B 3/14 405/20
6,079,902 A * 6/2000 Pettee, Jr. ..... E02B 3/14 405/20
6,253,518 B1 * 7/2001 Azar ..... E04B 2/06 52/592.1
6,267,533 B1 * 7/2001 Bourg ..... E02B 3/04 405/16
6,318,934 B1 * 11/2001 Borgersen ..... E02D 29/025 52/603
D463,041 S * 9/2002 Dice ..... D25/118
6,457,911 B1 * 10/2002 Scales ..... E02D 29/0241 405/262
6,467,229 B2 * 10/2002 Azar ..... E04B 2/06 52/592.1
6,508,607 B1 * 1/2003 Smith ..... E02B 3/14 52/603
6,564,524 B1 * 5/2003 Gruita ..... E04B 2/44 52/603
6,579,038 B1 * 6/2003 McAllister ..... E02B 3/123 52/603
D482,800 S * 11/2003 Dice ..... D25/115
D482,801 S * 11/2003 Dice ..... D25/115
6,722,094 B1 * 4/2004 Judd ..... E04C 1/41 52/404.4
6,866,446 B2 * 3/2005 McAllister ..... E02B 3/123 405/20
6,884,004 B1 * 4/2005 Scales ..... E02D 29/0241 405/262
6,939,077 B1 * 9/2005 Hart ..... E01C 11/225 404/34

(56) References Cited

U.S. PATENT DOCUMENTS 6,948,282 B2 * 9/2005 Bott ..... E04C 1/395 52/98
D575,414 S * 8/2008 Salerno ..... D25/118
7,806,038 B2 * 10/2010 Duke ..... F41H 5/04 89/36.01
7,850,402 B1 * 12/2010 Justiniano ..... A01G 24/44 405/286
7,963,727 B1 * 6/2011 Wauhop ..... E02D 29/0266 52/603
8,123,434 B1 * 2/2012 Smith ..... E02B 3/14 405/15
8,123,435 B1 * 2/2012 DeShaw ..... E02B 3/14 405/15
8,678,704 B1 * 3/2014 Smith ..... E02B 3/14 405/16
8,678,705 B1 * 3/2014 Smith ..... E02B 3/14 405/20
8,734,060 B1 * 5/2014 Wauhop ..... E02D 29/02 405/286
8,956,084 B2 * 2/2015 Kelly, Jr. ..... E02D 29/025 405/262
9,453,341 B1 * 9/2016 Swierad ..... E01F 8/0005
9,644,334 B2 * 5/2017 O'Neill ..... E02B 3/129
9,797,106 B1 * 10/2017 Smith ..... E02B 3/14
10,865,560 B1 * 12/2020 Morrow ..... E04B 2/16
11,959,274 B2 * 4/2024 Bowers ..... B29B 17/04
2001/0022054 A1 * 9/2001 Crant ..... E04F 11/116 52/569
2001/0029719 A1 * 10/2001 Azar ..... E04B 2/06 52/592.1
2002/0152709 A1 * 10/2002 Gresser ..... E04C 1/395 52/561
2003/0002925 A1 * 1/2003 Blomquist ..... E02D 29/025 405/262
2003/0147705 A1 * 8/2003 McAllister ..... E02B 3/123 405/262
2004/0163358 A1 * 8/2004 Clarke ..... E04C 3/12 52/782.1
2005/0108973 A1 * 5/2005 Hammer ..... E04C 1/395 52/596
2006/0000179 A1 * 1/2006 Albert ..... E04B 2/16 52/606
2006/0051166 A1 * 3/2006 Lee ..... E02D 29/0233 405/286
2007/0186502 A1 * 8/2007 Marsh ..... E04B 2/16 52/604
2007/0196184 A1 * 8/2007 Hammer ..... E02D 29/0283 405/284
2007/0266656 A1 * 11/2007 Blocken ..... C04B 28/02 52/286
2008/0075535 A1 * 3/2008 Han ..... E02B 3/14 405/16
2008/0134615 A1 * 6/2008 Risi ..... E02D 29/025 52/598
2009/0103988 A1 * 4/2009 Allington ..... E02D 29/025 52/585.1
2009/0185870 A1 * 7/2009 Shaw ..... E02D 29/0241 405/284
2010/0104366 A1 * 4/2010 Melby ..... E02B 3/129 405/16
2010/0227017 A1 * 9/2010 Lee Lum ..... E04C 1/392 425/444
2010/0282060 A1 * 11/2010 Duke ..... E04B 2/08 89/917
2010/0290842 A1 * 11/2010 Cho ..... E02D 29/025 405/272
2011/0072753 A1 * 3/2011 MacDonald ..... E02D 29/025 52/592.1
2011/0110728 A1 * 5/2011 Kim ..... E02D 29/0241 405/287.1
2011/0185673 A1 * 8/2011 Ferguson ..... B28B 7/0064 52/745.1
2011/0200390 A1 * 8/2011 Rodriguez ..... E02D 5/10 405/38
2013/0111842 A1 * 5/2013 Long ..... E04C 1/395 52/578
2013/0276401 A1 * 10/2013 MacDonald ..... E02D 29/02 52/606
2014/0119831 A1 * 5/2014 Hill ..... E02B 3/14 405/16
2014/0196397 A1 * 7/2014 Sourlis ..... E04B 2/24 52/568
2015/0050086 A1 * 2/2015 O'Neill ..... E02B 3/129 405/21
2015/0097312 A1 * 4/2015 MacDonald ..... B28B 7/0097 425/453
2015/0218805 A1 * 8/2015 Jensen ..... E04B 2/18 52/309.4
2017/0260743 A1 * 9/2017 Simonson ..... E04C 1/395
2020/0032513 A1 * 1/2020 Devito ..... E04B 2/50
2022/0064941 A1 * 3/2022 Bowers ..... E04B 2/18

* cited by examiner

TAPERED REVETMENT BLOCK WITH LEVELING PADS

CROSS-REFERENCE TO RELATED APPLICATION

The present application claims priority to U.S. Provisional Patent Application Ser. No. 63/218,712 filed on Jul. 6, 2021, the subject matter of which is incorporated herein in its entirety by reference.

BACKGROUND

Revetment mats are used to inhibit soil erosion from areas of flowing water along, for instance, shorelines, spillways, overflow channels, drainage channels, boat ramps, and the like. Revetment mats may be formed from articulated concrete blocks (e.g., revetment blocks) that interlock together and conform to specific hydraulic performance characteristics. Revetment blocks may have a flat bottom with sloped top such that the revetment block has a varying thickness from one side to another. Forming revetment mats are typically formed by arranging one layer of revetment blocks in a pattern on a flat surface in such a way that apertures through the revetment blocks align with one another. Cables may be strung through the aligned apertures to connect the revetment blocks together. This process can be quite labor intensive, as the revetment mats can only be constructed one layer at a time.

DETAILED DESCRIPTION

Figure 1A:
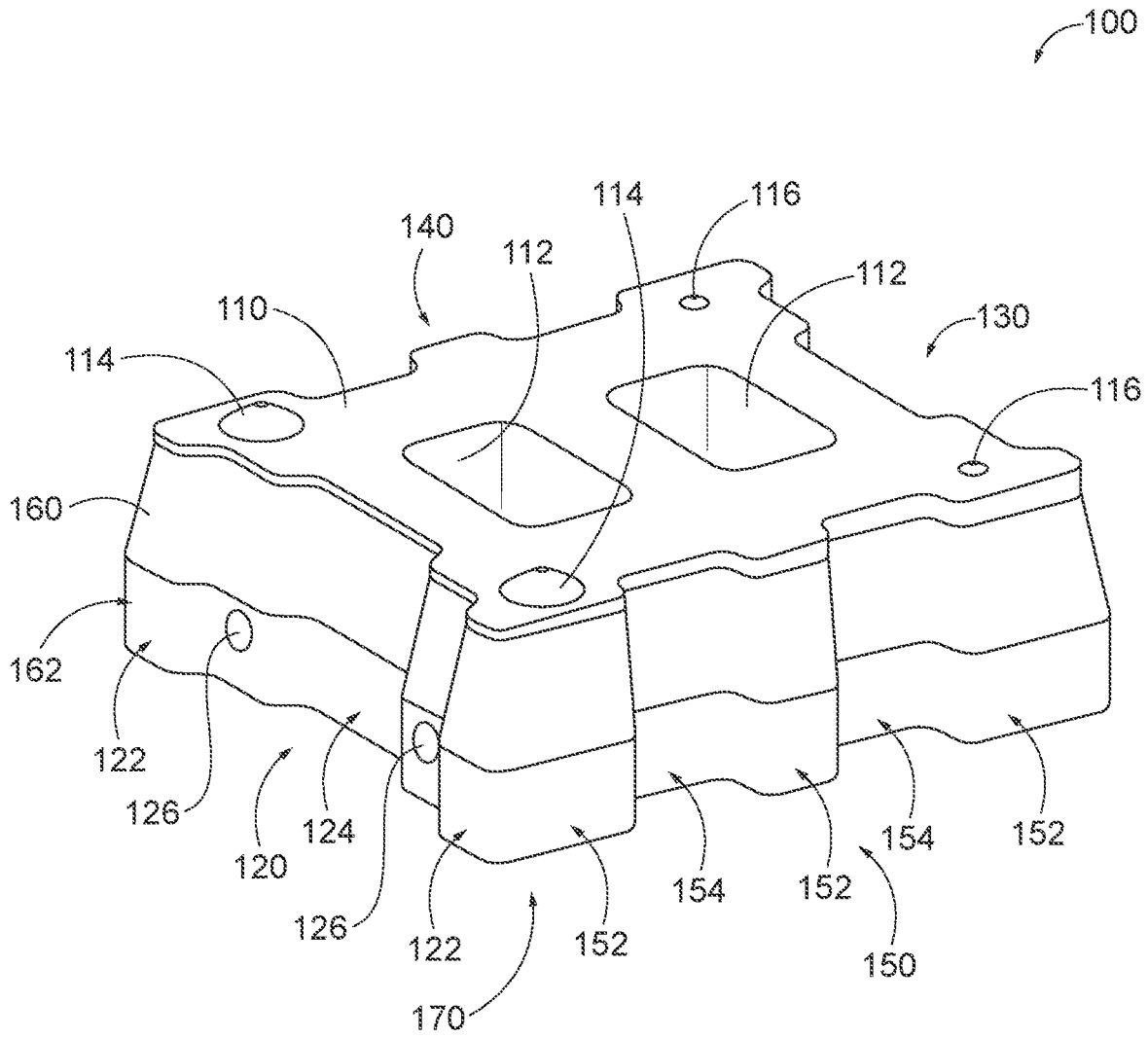
FIGS. 1A-1C depict an example revetment blocks with a front-to-back or back-to-front taper in accordance with embodiments of the disclosure.

Certain details are set forth below to provide a sufficient understanding of embodiments of the disclosure. It will be clear to one skilled in the art, however, that embodiments of the disclosure may be practiced without various aspects of these particular details.

This disclosure describes embodiments of a revetment block with leveling pads configured to, when stacked, vertically align one more horizontal ducts extending through each revetment block among a row of revetment blocks. The one or more horizontal ducts may be used to lace of cables to connect a group of blocks in the row of revetment blocks to form a revetment mat.

The revetment block may have a substantially rectangular footprint, with a top surface, a bottom surface, a front sidewall, a back sidewall, a left sidewall, and a right sidewall. Each of the sidewalls may include one or more recessed areas to allow the revetment block to interlock with adjacent revetment blocks to form a revetment mat. In some examples, the recessed areas may be U-shaped. At least a portion of one or more of the sidewalls may be tapered (e.g., non-perpendicular to the bottom or top surface) such that the top surface has a smaller surface area than the bottom surface. In some examples, the sidewalls are only tapered above the horizontal ducts to the top surface.

In some examples, the revetment blocks may include one or more apertures (e.g., holes, openings, etc.) that extend through the revetment block from the top surface to the bottom surface. The one or more apertures may be included for drainage and/or to allowing growth from floor or ground to anchor the revetment mat when installed. The one or more apertures may have sidewalls tapering from a wider or larger area at the top surface to a narrower or smaller lower area at the bottom surface. In some examples, the apertures may have a rectangular shape (e.g., with rounded corners), an ovular shape, a circular shape, etc. In some examples, the revetment block may include two or more apertures. In some examples, the recessed areas in the sidewalls may be sized such that the surface area at the top surface is half of the surface area of one of the one or more apertures at the top surface.

In some examples, the top surface of the revetment block may be tapered in one direction (e.g., front-to-back, back-to-front, left-to-right, or right-to-left) such that a height of the revetment block (e.g., measured between the top surface and the bottom surface) is different one side of the revetment block than it is on the opposite side. In some examples, the taper may have a fixed slope from one edge to the opposing edge.

In some examples, to form a revetment mat, a group of revetment blocks are arranged in a particular pattern where respective ones of the horizontal ducts extending through the revetment blocks are aligned with one another in one direction. Once arranged, cables are laced through the aligned horizontal ducts to tie the blocks together. The cabled revetment mat is then lifted and moved (e.g., using machinery) to the installation site for installation. In some examples, the cables are configured to make installation of the revetment blocks more efficient by allowing multiple ones of the revetment blocks to be installed contemporaneously.

In some examples, multiple individual revetment mats may be formed by stacking rows of the revetment blocks, with each row arranged in the particular pattern. Although the top surfaces of the revetment blocks may be tapered, the one or more leveling pads may provide a level surface to a next row of revetment blocks to be placed on top of a lower row such that the horizontal ducts are vertically aligned for cabling. The ability to form multiple individual revetment mats by stacking rows of revetment blocks on a flat surface may increase efficiency as compared with being limited to forming and moving one row at a time on a flat surface. For example, rather than pulling one block at a time off of a pallet to arrange for formation of the revetment mat, a stack of revetment blocks may be moved and arranged using a forklift or other machine. In some examples, the stack of blocks may be lifted and moved by inserting a rod through each horizontal duct in a bottom row of revetment blocks.

All of the above outlined objectives are to be understood as exemplary only and many more objectives of the invention may be gleaned from the disclosure herein. Therefore, no limiting interpretation of the objectives noted is to be understood without further reading of the entire specification, claims, and drawings included herewith.

Figure 1B:
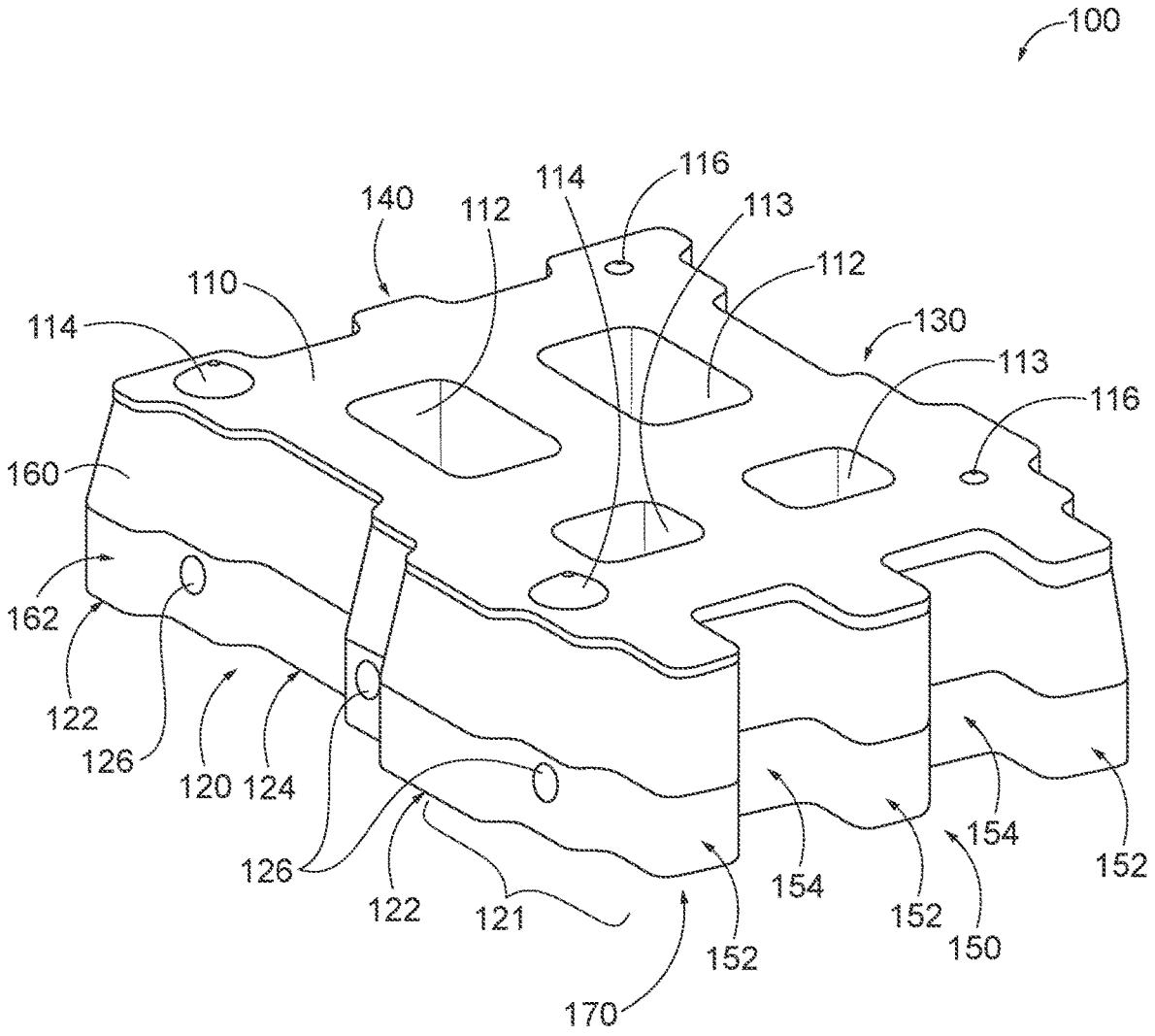
Figure 1C:
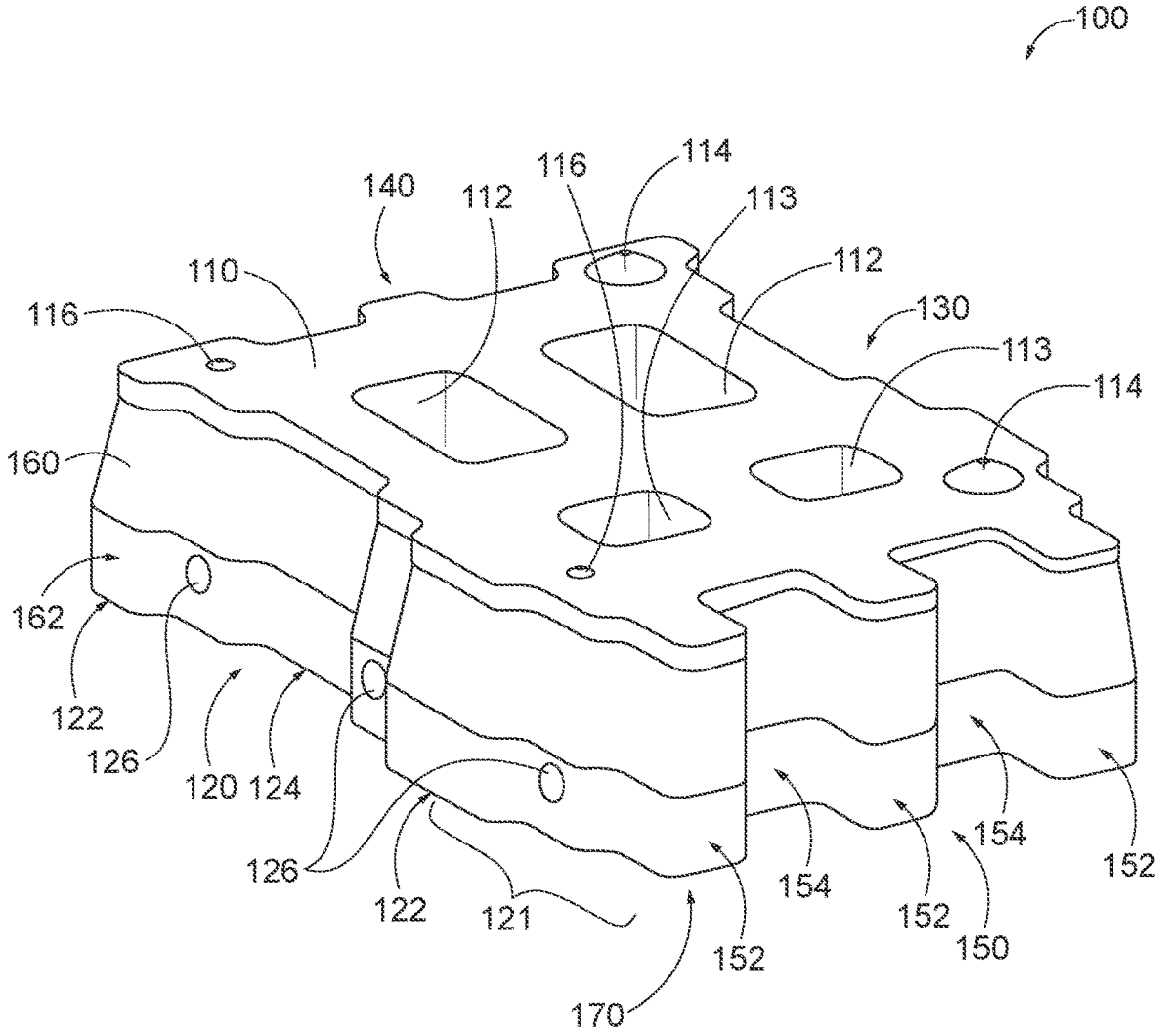

FIGS. 1A-1C depict an example revetment blocks 100, respectively, with a front-to-back or back-to-front taper in accordance with embodiments of the disclosure. FIG. 1A depicts a standard revetment block 100 with a front-to-back or back-to-front taper, FIG. 1B depicts a left-handed block-and-a half (BAH) revetment block 100 with front-to-back or back-to-front taper, and FIG. 1C depicts a right-handed BAH revetment block 100 with front-to-back or back-to-front taper.

Turning now to FIG. 1A, the revetment block 100 may be formed from a concrete material, such as a wet-cast, dry-cast, or a precast concrete material, in some examples. The revetment block 100 may have a substantially planar top surface 110 and bottom surface 170, and sidewalls, 120, 130, 140, and 150 extending between the top surface 110 and the bottom surface 170. The size of the revetment block 100 may vary depending on the application and desired hydraulic characteristics. In some examples, the revetment block 100 may have dimensions of up to 36 inches (along sidewalls 120 and 130) by 48 inches (along sidewalls 140 and 150) by 12 inches (from the top surface 110 to the bottom surface 170).

The bottom surface 170 may be substantially flat or planar such as to make substantially continuous contact with either a substrate soil or filter media. In some examples, the top surface 110 may be tapered from the sidewall 130 to the sidewall 120 (e.g., the sidewall 130 is taller than the sidewall 120) such that the top surface 110 is not parallel with the bottom surface 170. In some examples, the taper may be a constant positive slope from the sidewall 120 to the sidewall 130. In other examples, the top surface 110 may be partially tapered or have an uneven surface in some way between the sidewall 130 and the sidewall 120 such that a thickness of the revetment block 100 between the top surface 110 and the bottom surface 170 is different at an area adjacent the sidewall 130 than at an area adjacent the sidewall 120.

The revetment block 100 may have at least one aperture or opening (e.g., core or hollow core) 112 extending through the revetment block 100 to and/or through the bottom surface 170. The at least one aperture or opening 112 may allow foliage to grow through the revetment block 100 from the substrate soil, may release hydrostatic pressure from beneath the revetment block 100 by allowing water to flow through the revetment block 100, and/or may dissipate energy such as from waves which may buffet the revetment block 100. In some examples, the at least one aperture or opening 112 may have equal proportions with apertures or openings of other revetment blocks.

The opposed sidewalls 120 and 130 may be symmetrical and parallel, and the opposed sidewalls 140 and 150 may be symmetrical and parallel. The sidewalls 120, 130, 140, and 150 may be entirely tapered, in some examples. In other examples, the sidewalls 120, 130, 140, and 150 may be at least partially vertical. For example, the sidewall 120 is shown with a vertical portion 162 and a tapered portion 160 extending above the vertical portion 162 to the top surface 110 such that top surface 110 has less surface area than the bottom surface 170. The tapered portion 160 may allow the revetment block 100 to facilitate articulation of the matrix over non-planar surfaces. One or more of the other sidewalls may have similar vertical and tapered portions.

The opposed sidewalls 120 and 130 may include a recess 124 formed between projections 122. The recess 124 may be stepped down from the projections 122. The recess 124 may be sized to interlock with projections 122 of two revetment placed side-by-side. The opposed sidewalls 140 and 150 may include a symmetrical series of recesses 154 and projections 152. The recesses 154 may be U-shaped. In some examples, the recesses 154 may be sized to half of one of the opening or apertures 112.

The revetment block 100 may include one or more horizontal ducts or tunnels extending between opposed sidewalls 120 and 130. The ducts 126 may facilitate passing of a cable there-through to interlock rows of revetment blocks to form a revetment mat. The ducts 126 may be located in the recess 124. The ducts 126 may be positioned on the revetment block to align with interlocking ducts in interlocking revetment blocks to form a revetment mat.

In some examples, the top surface 110 may be tapered in one direction (e.g., front-to-back or back-to-front) such that a height of the revetment block (e.g., measured between the top surface 110 and the bottom surface 170) is different one side of the revetment block 100 than it is on the opposite side. In some examples, the taper may have a fixed slope from one edge to the opposing edge.

In some examples, to form a revetment mat, a group of revetment blocks may be arranged in a particular pattern where respective ones of the horizontal ducts 126 extending through the revetment blocks 100 are aligned with one another in one direction. Once arranged, cables are laced through the aligned horizontal ducts 126 to tie the blocks together. The cabled revetment mat may then be lifted and moved (e.g., using machinery) to the installation site for installation. In some examples, the cables are configured to make installation of the revetment blocks more efficient by allowing multiple ones of the revetment blocks to be installed contemporaneously.

In some examples, multiple individual revetment mats may be formed by stacking rows of the revetment blocks, with each row arranged in the particular pattern. Although the top surface 110 of the revetment blocks may be tapered, the one or more leveling pads 114 and 116 may provide a level surface to a next row of revetment blocks to be placed on top of a lower row such that the horizontal ducts are horizontally aligned (e.g., aligned in the same horizontal plane) for cabling.

The leveling pads 114 and 116 may provide a pad or surface on which an upper row of revetment blocks may be positioned. A height of the leveling pads 114 and the leveling pads 116 may be selected to offset the taper of the top surface 110. In some examples, the leveling pads 114 and 116 have a circular base that tapers toward a flat circular top surface (e.g., or a tip) to form a conical frustum. The surface area of the top surface of the leveling pads 114 and 116 may be based on a size of the blocks and a degree of the slope. In some examples, the top surface of the leveling pads 114 and 116 may be parallel with the horizontal ducts 126. In some examples, the leveling pads 114 may be larger in volume than the leveling pads 116. In some examples, the leveling pads 114 and 116 may have different shapes, such as a square, rectangular, pentagonal, etc., prism with square flat top surface (e.g., frustum).

The ability to form multiple individual revetment mats by stacking rows of revetment blocks on a flat surface (e.g., via the leveling pads 114 and 116) may increase efficiency as compared with being limited to forming and moving one row at a time on a flat surface. For example, rather than pulling one block at a time to arrange for formation of the revetment mat, a stack of revetment blocks may be moved and arranged using a forklift or other machine. For example, rather than pulling one block at a time to arrange for formation of the revetment mat, a stack of revetment blocks may be moved and arranged using a forklift or other machine and lifting implement (e.g., a lifting implement attached to an electric motor, an air hoist, a pneumatic lifting device, a hydraulic pump, etc.). In some examples, the stack of blocks may be lifted and moved by inserting a rod or other specialized lifting apparatus through each horizontal duct 126 in a bottom row of revetment blocks.

Turning now to FIG. 1B, the left-handed BAH revetment block 100 may be similar to the revetment block 100 of FIG. 1A, but may include an additional half of a block extending in a direction parallel to the sidewalls 120 and 130. The left-handed BAH revetment block 100 may include elements that have been previously described with respect to the revetment block 100 of FIG. 1A. Those elements have been identified in FIG. 1B using the same reference numbers used in FIG. 1A and operation of the common elements is as previously described. Consequently, a detailed description of the operation of these particular elements will not be repeated in the interest of brevity.

As shown, the left-handed BAH revetment block 100 includes an extra half portion 121 along each of the sidewalls 120 and 130 (as well as the top surface 110 and the bottom surface 170). Therefore, the extra half portion 121 is the equivalent of one of the projections 122 and one-half of the recess 124. The extra half portion 121 may further include an additional one of the ducts 126 for cabling. The top surface 110 may further include additional apertures (e.g., cores or hollow cores) 113 that are smaller than the one or more apertures 112. In some examples, the additional apertures 113 may be half of the size in surface area at the top surface as the one or more apertures 112. The left-handed BAH revetment block 100 may be left-handed, because it may be placed on a left-hand side of a revetment mat, in some examples.

Turning now to FIG. 1C, the right-handed BAH revetment block 100 may be similar to the revetment block 100 of FIG. 1A, but may include an additional half of a block extending in a direction parallel to the sidewalls 120 and 130. The right-handed BAH revetment block 100 may include elements that have been previously described with respect to the revetment block 100 of FIG. 1A and the left-handed BAH revetment block 100 of FIG. 1B. Those elements have been identified in FIG. 1C using the same reference numbers used in FIGS. 1A and 1B and operation of the common elements is as previously described. Consequently, a detailed description of the operation of these particular elements will not be repeated in the interest of brevity.

As shown, the right-handed BAH revetment block 100 includes the extra half portion 121 along each of the sidewalls 120 and 130 (as well as the top surface 110 and the bottom surface 170). The right-handed BAH revetment block 100 may be right-handed, because it may be placed on a right-hand side of a revetment mat, in some examples. Accordingly, the relative positions of leveling pads 114 vs. the positions of the leveling pads 116 may be swapped as compared with the left-handed BAH revetment block 100.

Figure 2A:
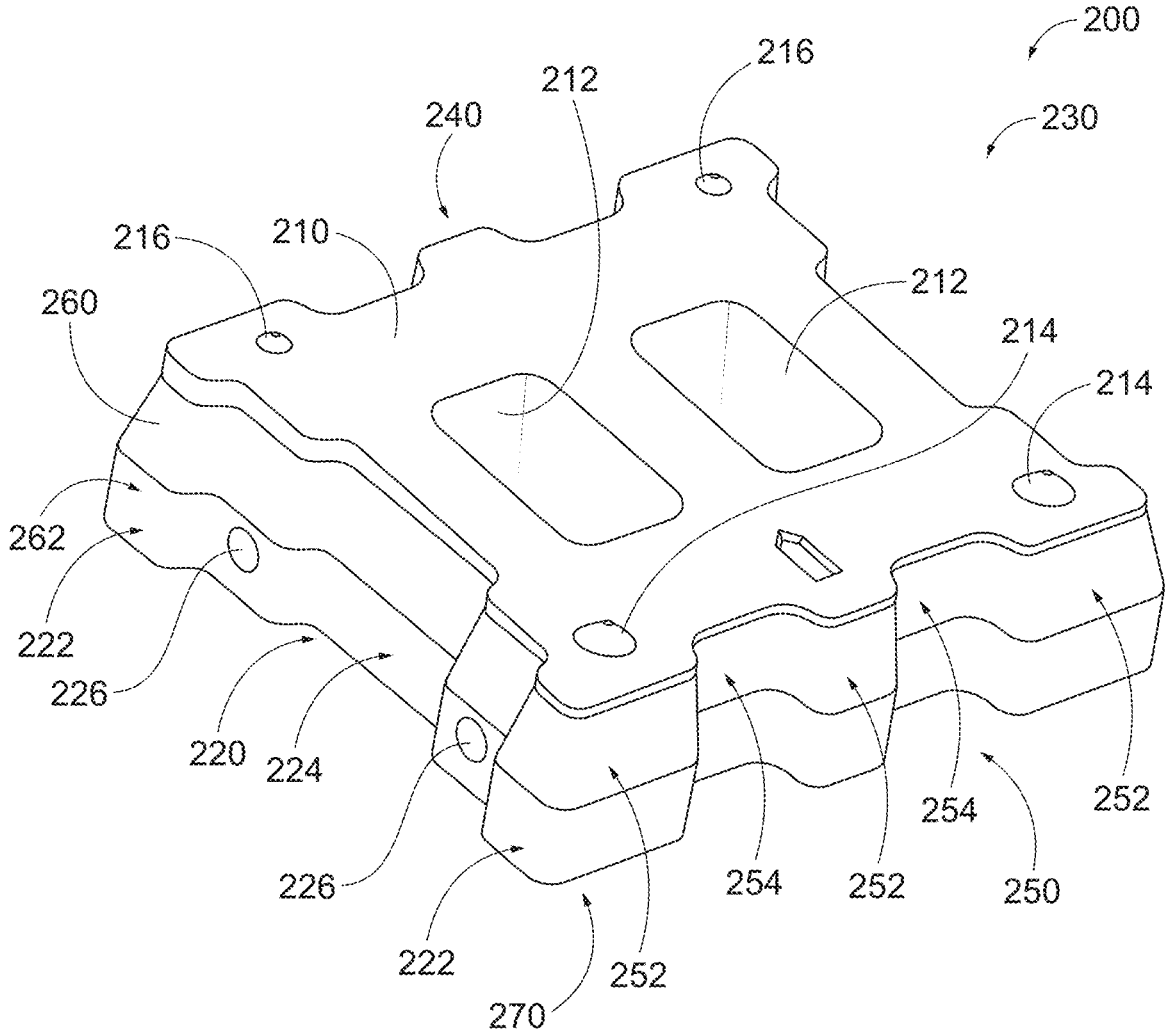
FIGS. 2A-2C depict an example revetment blocks with a side-to-side (SS) taper in accordance with embodiments of the disclosure.
Figure 2B:
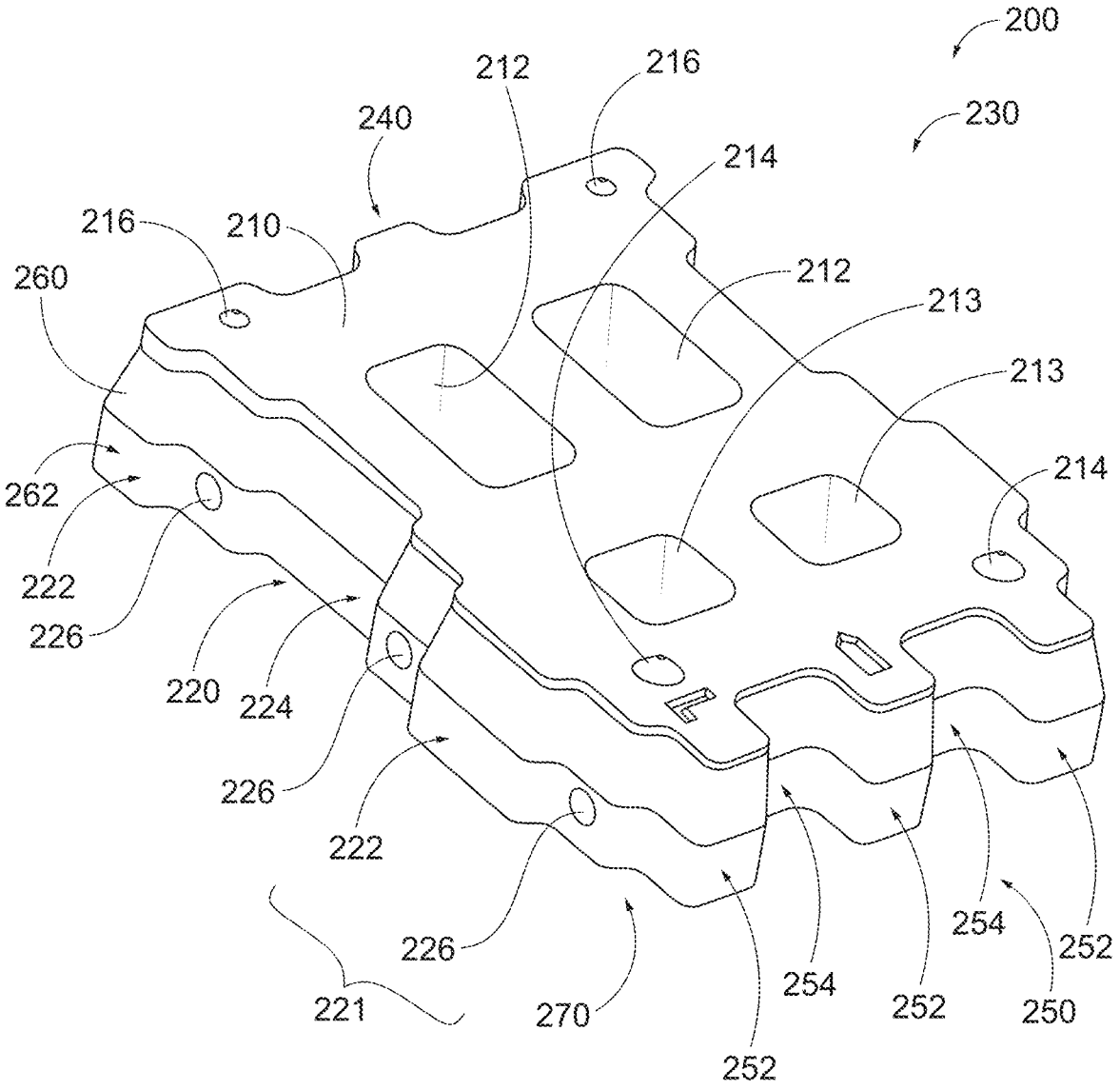
Figure 2C:
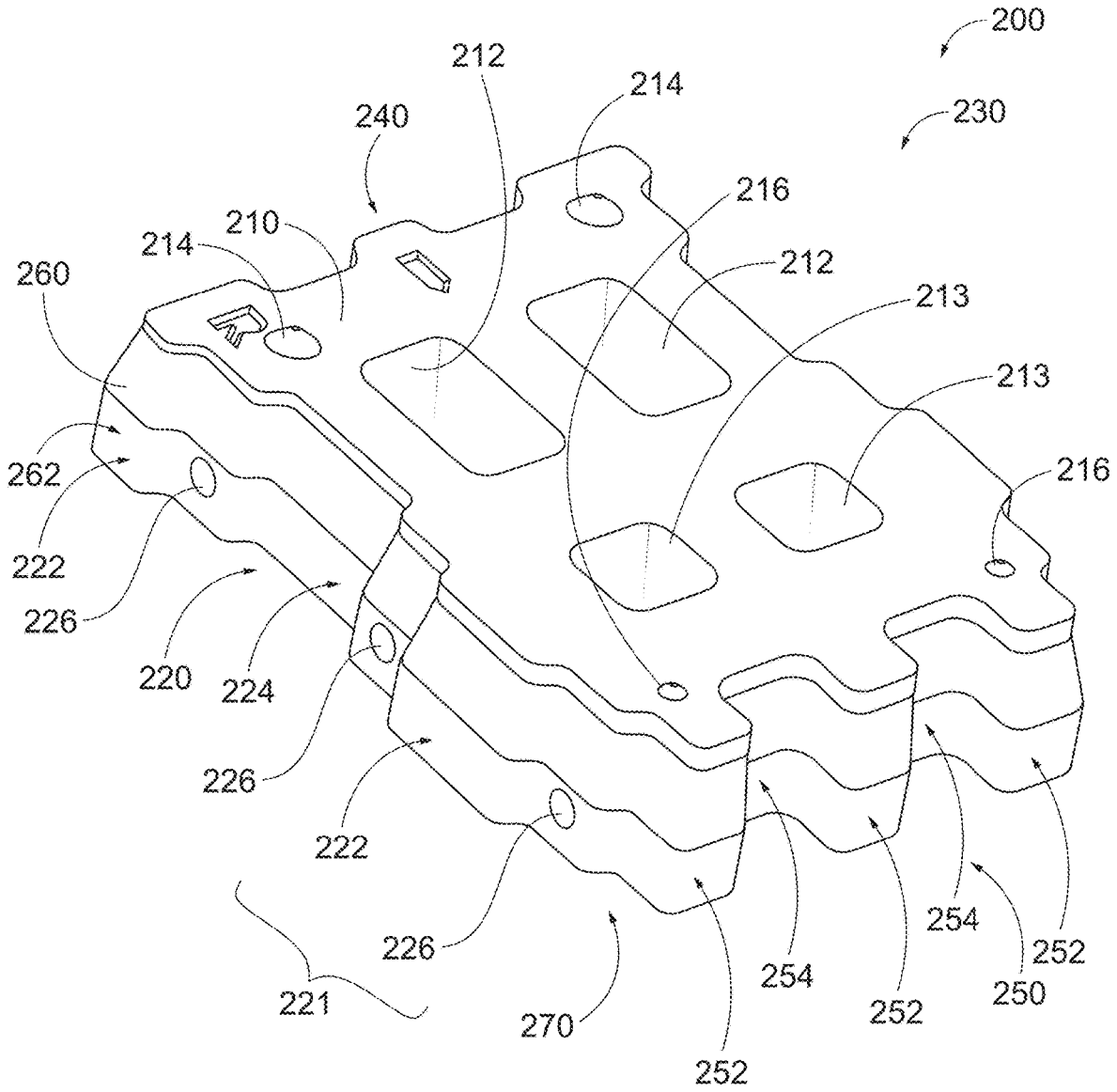

FIGS. 2A-2C depict an example revetment blocks 200, respectively, with a side-to-side (SS) taper in accordance with embodiments of the disclosure. FIG. 2A depicts a standard revetment block 200 with a SS taper, FIG. 2B depicts a left-handed block-and-a half (BAH) revetment block 200 with SS taper, and FIG. 2C depicts a right-handed BAH revetment block 200 with a SS taper.

Turning now to FIG. 2A, the revetment block 200 may be is formed from precast concrete, in some examples. The revetment block 200 may have a substantially planar top surface 210 and bottom surface 270, and sidewalls, 220, 230, 240, and 250 extending between the top surface 210 and the bottom surface 270. The size of the revetment block 200 may vary depending on the application and desired hydraulic characteristics. In some examples, the revetment block 200 may have dimensions of up to 36 inches (along sidewalls 220 and 230) by 48 inches (along sidewalls 240 and 250) by 12 inches (from the top surface 210 to the bottom surface 270).

The bottom surface 270 may be substantially flat or planar such as to make substantially continuous contact with either a substrate soil or filter media. In some examples, the top surface 210 may be tapered from the sidewall 240 to the sidewall 250 (e.g., the sidewall 240 is taller than the sidewall 250) such that the top surface 210 is not parallel with the bottom surface 270. In some examples, the taper may be a constant positive slope from the sidewall 250 to the sidewall 240. In other examples, the top surface 210 may be partially tapered or have an uneven surface in some way between the sidewall 240 and the sidewall 250 such that a thickness of the revetment block 200 between the top surface 210 and the bottom surface 270 is different at an area adjacent the sidewall 240 than at an area adjacent the sidewall 250.

The revetment block 200 may have at least one aperture or opening (e.g., core or hollow core) 212 extending through the revetment block 200 to and/or through the bottom surface 270. The at least one aperture or opening 212 may allow foliage to grow through the revetment block 200 from the substrate soil, may release hydrostatic pressure from beneath the revetment block 200 by allowing water to flow through the revetment block 200, and/or may dissipate energy such as from waves which may buffet the revetment block 200. In some examples, the at least one aperture or opening 212 may have equal proportions with apertures or openings of other revetment blocks.

The opposed sidewalls 220 and 230 may be symmetrical and parallel, and the opposed sidewalls 240 and 250 may be symmetrical and parallel. The sidewalls 220, 230, 240, and 250 may be entirely tapered, in some examples. In other examples, the sidewalls 220, 230, 240, and 250 may be at least partially vertical. For example, the sidewall 220 is shown with a vertical portion 262 and a tapered portion 260 extending above the vertical portion 262 to the top surface 210 such that top surface 210 has less surface area than the bottom surface 270. The tapered portion 260 may allow the revetment block 200 to facilitate articulation of the matrix over non-planar surfaces. One or more of the other sidewalls may have similar vertical and tapered portions.

The opposed sidewalls 220 and 230 may include a recess 224 formed between projections 222. The recess 224 may be stepped down from the projections 222. The recess 224 may be sized to interlock with projections 222 of two revetment placed side-by-side. The opposed sidewalls 240 and 250 may include a symmetrical series of recesses 254 and projections 252. The recesses 254 may be U-shaped. In some examples, the recesses 254 may be sized to half of one of the opening or apertures 212.

The revetment block 200 may include one or more horizontal ducts or tunnels extending between opposed sidewalls 220 and 230. The ducts 226 may facilitate passing of a cable there-through to interlock rows of revetment blocks to form a revetment mat. The ducts 226 may be located in the recess 224. The ducts 226 may be positioned on the revetment block to align with interlocking ducts in interlocking revetment blocks to form a revetment mat.

In some examples, the top surface 210 may be tapered in one direction (e.g., side-to-side) such that a height of the revetment block (e.g., measured between the top surface 210 and the bottom surface 270) is different one side of the revetment block 200 than it is on the opposite side. In some examples, the taper may have a fixed slope from one edge to the opposing edge.

In some examples, to form a revetment mat, a group of revetment blocks may be arranged in a particular pattern where respective ones of the horizontal ducts 226 extending through the revetment blocks 200 are axially aligned with one another in one direction. Once arranged, cables are laced through the axially-aligned horizontal ducts 226 to tie the blocks together. The cabled revetment mat may then be lifted and moved (e.g., using machinery) to the installation site for installation. In some examples, the cables are configured to make installation of the revetment blocks more efficient by allowing multiple ones of the revetment blocks to be installed contemporaneously.

In some examples, multiple individual revetment mats may be formed by stacking rows of the revetment blocks, with each row arranged in the particular pattern. Although the top surface 210 of the revetment blocks may be tapered, the one or more leveling pads 214 and 216 may provide a level surface to a next row of revetment blocks to be placed on top of a lower row such that the horizontal ducts are axially aligned for cabling. The leveling pads 214 and 216 may provide a pad or surface on which an upper row of revetment blocks may be positioned. A height of the leveling pads 214 and the leveling pads 216 may be selected to offset the taper of the top surface 210.

In some examples, the leveling pads 214 and 216 have a circular base that tapers toward a flat circular top surface (e.g., or a tip) to form a conical frustum. The surface area of the top surface of the leveling pads 214 and 216 may be based on a size of the blocks and a degree of the slope. In some examples, the top surface of the leveling pads 214 and 216 may be parallel with the horizontal ducts 226. In some examples, the leveling pads 214 may be larger in volume than the leveling pads 216. In some examples, the leveling pads 214 and 216 may have different shapes, such as a square, rectangular, pentagonal, etc., prism with square flat top surface (e.g., frustum).

The ability to form multiple individual revetment mats by stacking rows of revetment blocks on a flat surface (e.g., via the leveling pads 214 and 216) may increase efficiency as compared with being limited to forming and moving one row at a time on a flat surface. For example, rather than pulling one block at a time to arrange for formation of the revetment mat, a stack of revetment blocks may be moved and arranged using a forklift or other machine and lifting implement (e.g., a lifting implement attached to an electric motor, an air hoist, a pneumatic lifting device, a hydraulic pump, etc.). In some examples, the stack of blocks may be lifted and moved by inserting a rod or other specialized lifting implement through each horizontal duct 226 in a bottom row of revetment blocks.

Turning now to FIG. 2B, the left-handed BAH revetment block 200 may be similar to the revetment block 200 of FIG. 2A, but may include an additional half of a block extending in a direction parallel to the sidewalls 220 and 230. The left-handed BAH revetment block 200 may include elements that have been previously described with respect to the revetment block 200 of FIG. 2A. Those elements have been identified in FIG. 2B using the same reference numbers used in FIG. 2A and operation of the common elements is as previously described. Consequently, a detailed description of the operation of these particular elements will not be repeated in the interest of brevity.

As shown, the left-handed BAH revetment block 200 includes an extra half portion 221 along each of the sidewalls 220 and 230 (as well as the top surface 210 and the bottom surface 270). Therefore, the extra half portion 221 is the equivalent of one of the projections 222 and one-half of the recess 224. The extra half portion 221 may further include an additional one of the ducts 226 for cabling. The top surface 210 may further include additional apertures (e.g., cores or hollow cores) 213 that are smaller than the one or more apertures 212. In some examples, the additional apertures 213 may be half of the size in surface area at the top surface as the one or more apertures 212. The left-handed BAH revetment block 200 may be left-handed, because it may be placed on a left-hand side of a revetment mat, in some examples.

In some examples, the slope of the taper of the top surface 210 of the left-handed BAH revetment block 200 may be the same as the slope of the taper of the top surface 210 of the revetment block 200 of FIG. 2A, with one or both of the sidewalls 240 and 250 having a different respective height on the left-handed BAH revetment block 200 as compared with the revetment block 200 of FIG. 2A. In other examples, the slope of the taper of the top surface 210 of the left-handed BAH revetment block 200 may be different than the slope of the taper of the top surface 210 of the revetment block 200 of FIG. 2A, such that both of the sidewalls 240 and 250 have a same respective height on the left-handed BAH revetment block 200 as compared with the revetment block 200 of FIG. 2A. Because of the greater distance between the pair of leveling pads 214 and the pair of leveling pads 216, the relative heights of one or both pairs of leveling pads 214 and 216 of the left-handed BAH revetment block 200 may be different than the relative heights of the one or both pairs of leveling pads of the revetment block 200 of FIG. 2A.

Turning now to FIG. 2C, the right-handed BAH revetment block 200 may be similar to the revetment block 200 of FIG. 2A, but may include an additional half of a block extending in a direction parallel to the sidewalls 220 and 230. The right-handed BAH revetment block 200 may include elements that have been previously described with respect to the revetment block 200 of FIG. 2A and the left-handed BAH revetment block 200 of FIG. 2B. Those elements have been identified in FIG. 2C using the same reference numbers used in FIGS. 2A and 2B and operation of the common elements is as previously described. Consequently, a detailed description of the operation of these particular elements will not be repeated in the interest of brevity.

As shown, the right-handed BAH revetment block 200 includes the extra half portion 221 along each of the sidewalls 220 and 230 (as well as the top surface 210 and the bottom surface 270). The right-handed BAH revetment block 200 may be right-handed, because it may be placed on a right-hand side of a revetment mat, in some examples. Accordingly, the relative positions of leveling pads 214 vs. the positions of the leveling pads 216 may be swapped as compared with the left-handed BAH revetment block 200 of FIG. 2B.

In some examples, the slope of the taper of the top surface 210 of the right-handed BAH revetment block 200 may be the same as the slope of the taper of the top surface 210 of the revetment block 200 of FIG. 2A, with one or both of the sidewalls 240 and 250 having a different respective height on the right-handed BAH revetment block 200 as compared with the revetment block 200 of FIG. 2A. In other examples, the slope of the taper of the top surface 210 of the right-handed BAH revetment block 200 may be different than the slope of the taper of the top surface 210 of the revetment block 200 of FIG. 2A, such that both of the sidewalls 240 and 250 have a same respective height on the right-handed BAH revetment block 200 as compared with the revetment block 200 of FIG. 2A. Because of the greater distance between the pair of leveling pads 214 and the pair of leveling pads 216, the relative heights of one or both pairs of leveling pads 214 and 216 of the right-handed BAH revetment block 200 may be different than the relative heights of the one or both pairs of leveling pads of the revetment block 200 of FIG. 2A.

FIGS. 3A-3E depict various views 300, 302, 304, 306, and 308 of rows, stacks and layers of the revetment block 100 of FIG. 1A in accordance with embodiments of the disclosure. While FIGS. 3A-3E depict rows, stacks and layers using the revetment block 100 of FIG. 1A, similar rows, stack and layers using revetment blocks 100 of FIGS. 1B and 1C, and/or the revetment blocks 200 of FIGS. 2A-2C, respectively, may be used without departing from the scope of the disclosure.

Figure 3A:
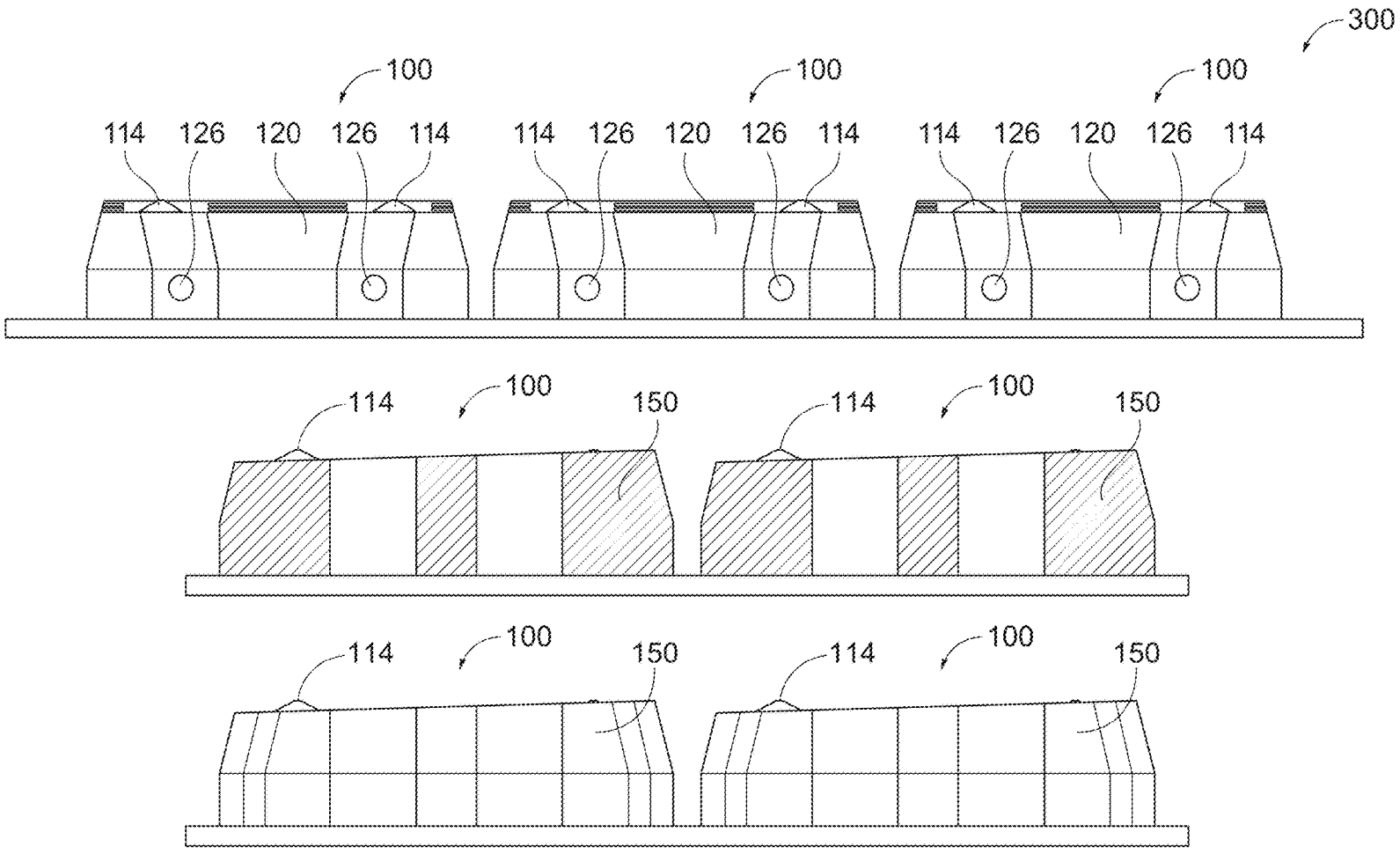
FIGS. 3A-3E depict various views of stacks of the revetment block of FIG. 1A in accordance with embodiments of the disclosure.
Figure 3B:
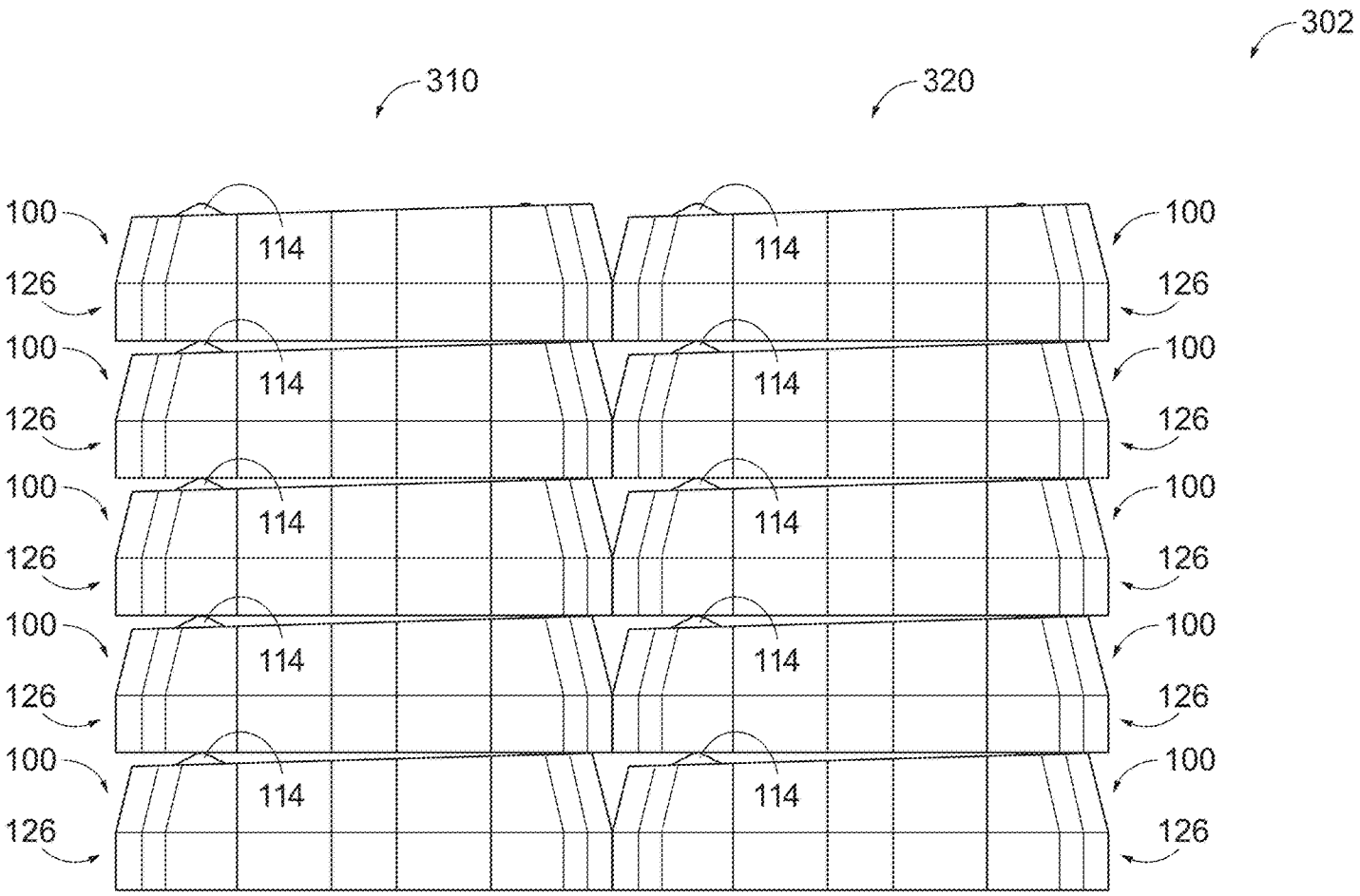
Figure 3C:
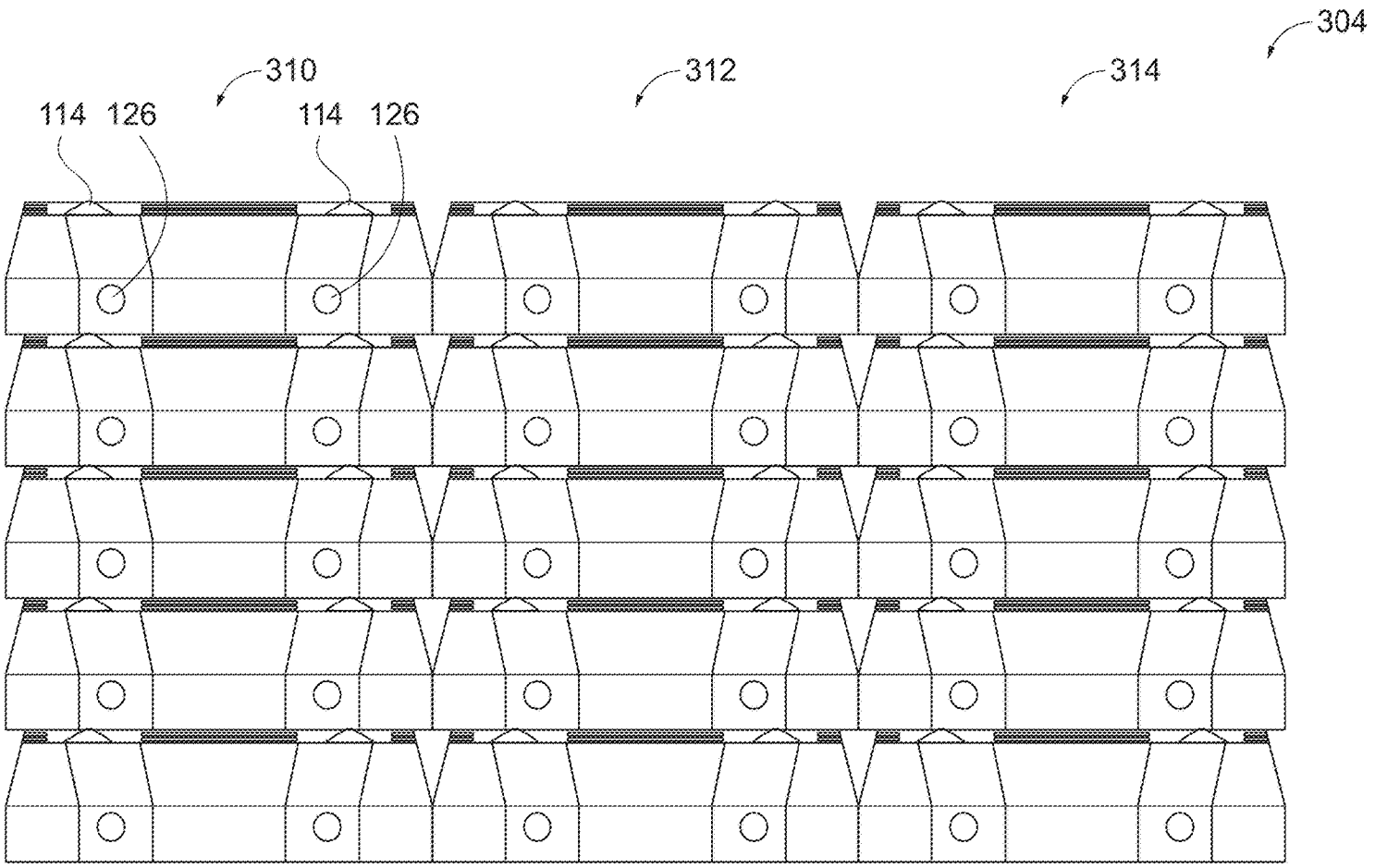
Figure 3D:
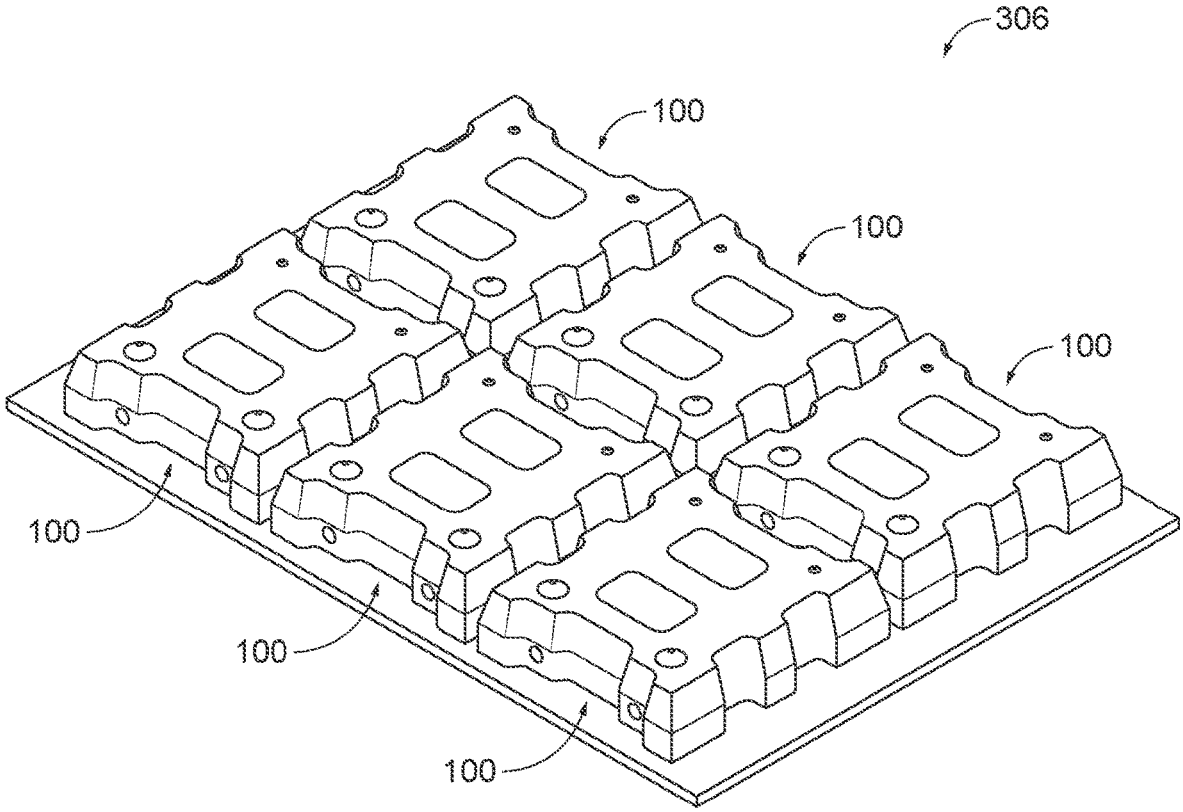
Figure 3E:
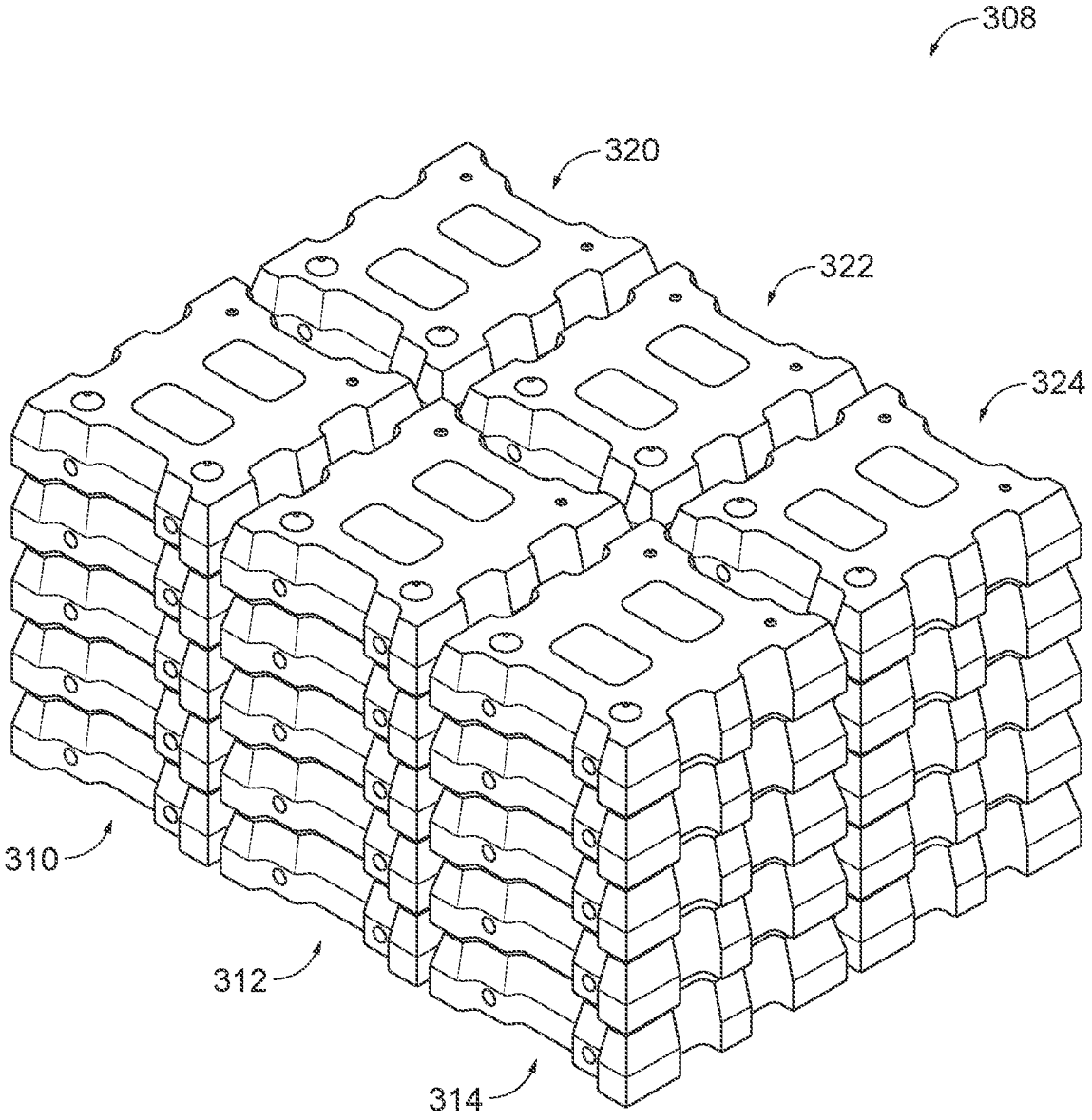

FIG. 3A depicts side views 300 of a row of revetment blocks 100, FIG. 3B depicts a first side view 302 of stacks of revetment blocks 100, FIG. 3C depicts a second side view 304 of stacks of revetment blocks 100, FIG. 3D depicts an isometric side view 306 of a layer of revetment blocks 100, and FIG. 3E depicts an isometric view 308 of stacks of revetment blocks 100. FIGS. 3A-3E may include elements that have been previously described with respect to the revetment block 100 of FIG. 1A. Those elements have been identified in FIGS. 3A-3E using the same reference numbers used in FIG. 1A, and operation of the common elements is as previously described. Consequently, a detailed description of the operation of these particular elements will not be repeated in the interest of brevity.

As shown in FIGS. 3A and 3D, when placed on a flat surface, the ducts 126 of the revetment blocks 100 are axially aligned in a common plane. As shown in FIGS. 3B, 3C, 3D, and 3E, when the revetment blocks are stacked, the leveling pads 116 may keep the horizontal ducts in a common plane within each row for a left, front stack 310; a middle, front stack 312; a right, front stack 314; a left, rear stack 320, a middle; rear stack 322; and a right, rear stack 324, for cabling.

Figure 4A:
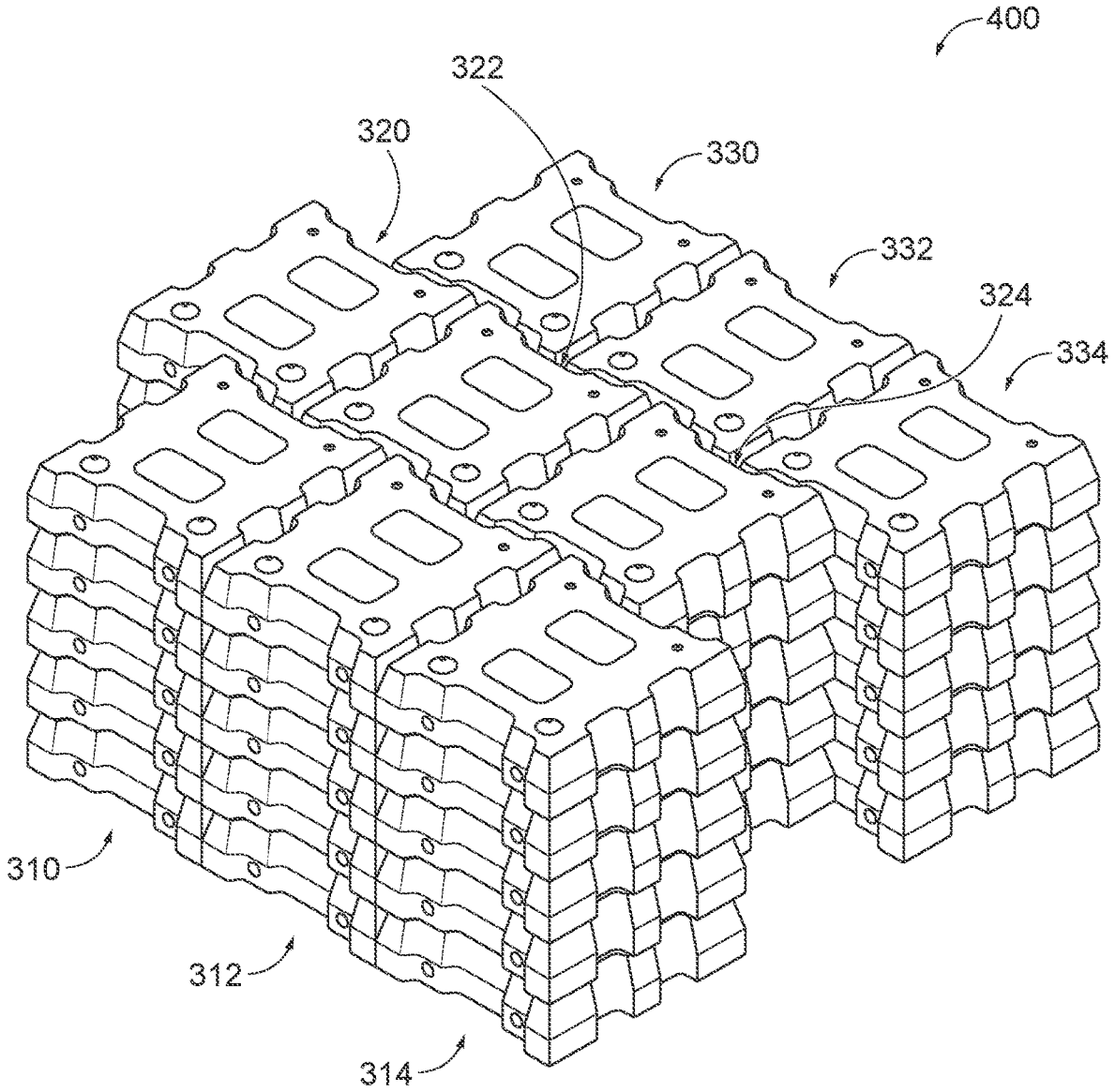
FIG. 4A depicts an isometric view of a revetment mat in accordance with embodiments of the disclosure.

FIG. 4A depicts an isometric view of a revetment mat 400 in accordance with embodiments of the disclosure. While FIG. 4A depicts stacks using the revetment block 100 of FIG. 1A, similar stacks using the revetment blocks 100 of FIGS. 1B and 1C, and/or the revetment blocks 200 of FIGS. 2A-2C, respectively, may be used without departing from the scope of the disclosure. As shown in FIG. 4A, the revetment mat 400 may include the left, front stack 310; the middle, front stack 312; the right, front stack 314; the left, rear stack 320, the middle; rear stack 322; and the right, rear stack 324 of FIGS. 3B, 3C, and 3E, plus an additional set of stacks 330, 332, and 334. The left, rear stack 320, the middle; rear stack 322; and the right, rear stack 324 may be horizontally offset from the left, front stack 310; the middle, front stack 312; and the right, front stack 314 to allow the blocks to interlock (e.g., in the recess 124 of the revetment block 100 of FIG. 1A. The additional stacks of blocks 330, 332, and 334 may be similarly horizontally offset relative to the left, rear stack 320, the middle; rear stack 322; and the right, rear stack 324 to facilitate interlocking.

In an example, each set of stacks (e.g., stacks 310, 312, and 314; stacks 320, 322, 324, or stacks 330, 332, or 334) may be contemporaneously placed into position to form the revetment mat 400 using a specialized lifting machine and implement. For example, the stacks may be lifted off of a pallet or a truck using the specialized lifting machine and implement, and may be placed into the relative offset positions for the revetment mat 400.

Figure 4B:
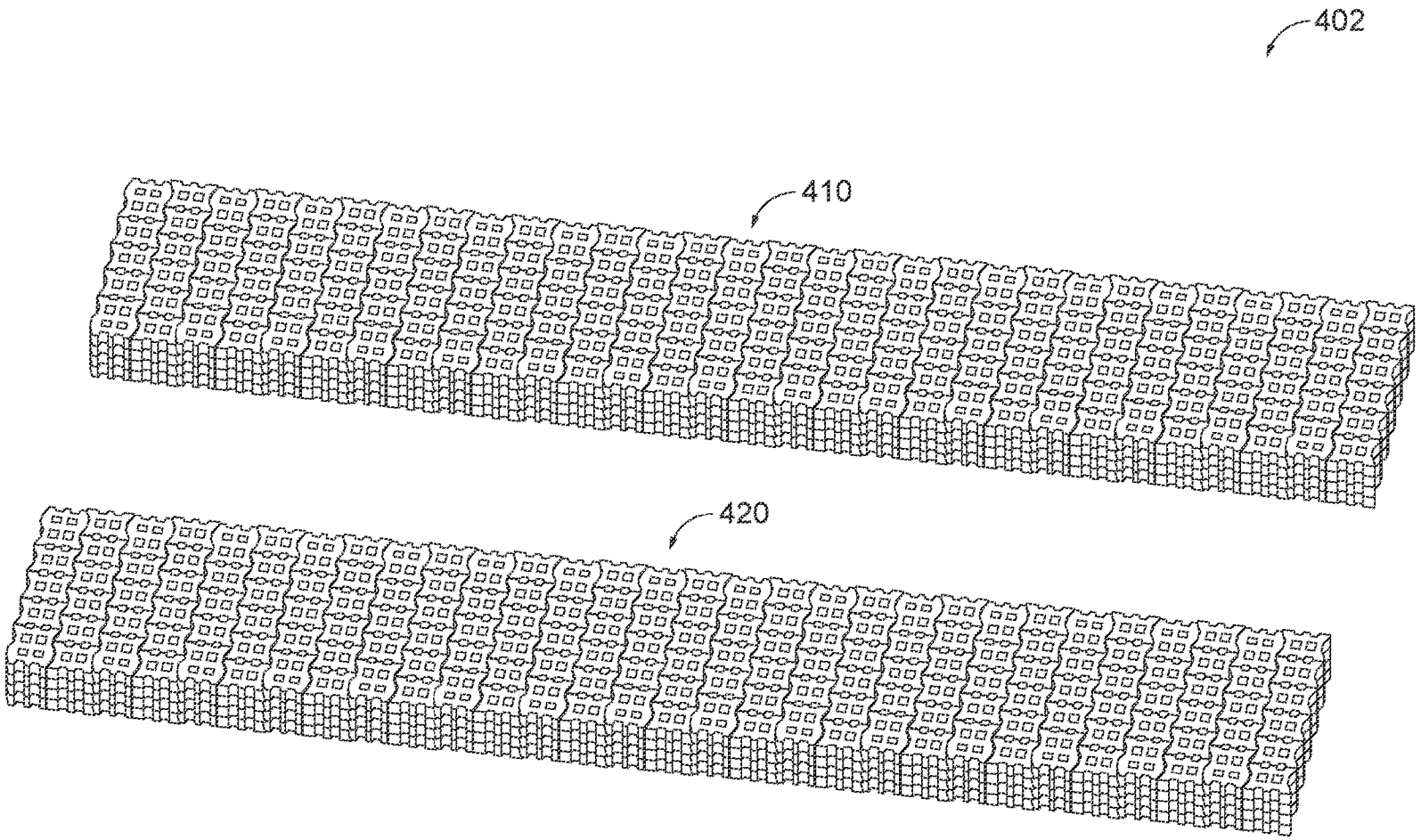
FIG. 4B depicts an isometric view of large arrays of revetment block stacks made up of various revetment blocks of FIGS. 1A-1C and/or FIGS. 2A-2C, in accordance with embodiments of the disclosure.

FIG. 4B depicts an isometric view 402 of large arrays 410 and 420 of revetment block stacks made up of various ones of the revetment blocks 100 of FIGS. 1A-1C, respectively, and/or the revetment block 200 of FIGS. 2A-2C, respectively, in accordance with embodiments of the disclosure. The ability to form large arrays of revetment block stacks may make forming revetment mats more efficient as compared with being limited to making a single row revetment mat array. For example, rather than pulling one block at a time to arrange for formation of a single row revetment block array, pulling and moving stacks of revetment blocks to form a multi-row revetment block array using a forklift or other machine and lifting implement may save time, space, and may reduce likelihood of injury.

The previous description of the disclosed embodiments is provided to enable a person skilled in the art to make or use the disclosed embodiments. Various modifications to these embodiments will be readily apparent to those skilled in the art, and the principles defined herein may be applied to other embodiments without departing from the scope of the disclosure. Thus, the present disclosure is not intended to be limited to the embodiments shown herein but is to be accorded the widest scope possible consistent with the principles and novel features as previously described.

What is claimed is:

1. A revetment block, comprising:

a top surface of the revetment block;

a bottom surface, wherein the top surface is opposite the bottom surface;

a first sidewall extending between the top surface and the bottom surface;

a second sidewall extending between the top surface and the bottom surface; and a horizontal duct extending from the first sidewall to the second sidewall, wherein the horizontal duct is parallel with the bottom surface;

wherein the top surface has a non-parallel relationship with the bottom surface;

a first leveling pad comprising a first prism or frustum shape having a height extending from the top surface of the revetment block adjacent the first sidewall, wherein the first leveling pad is configured for a second horizontal duct of a second such revetment block stacked on the top surface to be parallel with the first horizontal duct; and a second leveling pad adjacent the first sidewall, wherein the second leveling pad comprises a second prism or frustrum shape having a same height extending from the top surface of the revetment block as the first leveling pad, wherein the second leveling pad is further configured for the second horizontal duct of the second such revetment block stacked on the top surface to be parallel with the first horizontal duct.

2. The revetment block of claim 1, further comprising a third horizontal duct extending from the first sidewall to the second sidewall, wherein the third horizontal duct is parallel with the bottom surface.

3. The revetment block of claim 1, further comprising third and fourth leveling pads spaced apart along the top surface and adjacent the second sidewall, wherein the third and fourth leveling pads have a different height or different heights extending from the top surface than the first leveling pad and the second leveling pad, and wherein the third and fourth leveling pads are further configured for the second horizontal duct of the second such revetment block stacked on the top surface to be parallel with the first horizontal duct.

4. The revetment block of claim 1, wherein the first leveling pad and the second leveling pad are equidistant from an edge of the top surface adjacent the first sidewall.

5. The revetment block of claim 1, wherein the top surface is tapered from the first sidewall to the second sidewall such that a height or thickness of the revetment block is different adjacent the first sidewall and adjacent the second sidewall, and wherein the height of the first leveling pad is selected to offset the different thickness adjacent the first sidewall and the second sidewall.

6. The revetment block of claim 1, wherein the first and second side walls include a portion which is tapered inwardly towards the top surface such that an area of the top surface is less than an area of the bottom surface.

7. The revetment block of claim 1, further comprising a second pair of opposing sidewalls that each extend between the first sidewall and the second sidewall, wherein the pair of opposing sidewalls include one or more recessed areas adapted for the revetment block to interlock with adjacent revetment blocks to form a revetment mat.

8. The revetment block of claim 1, wherein the first and second sidewalls are opposite each other and the horizontal ducts are configured to connect a group of such revetment blocks with cabling to form a revetment mat.

9. The revetment block of claim 1, wherein the first and second sidewalls are horizontally parallel to one other.

10. The revetment block of claim 1, further comprising one or more hollow cores or openings extending from the top surface to the bottom surface of the revetment block, between the first and second sidewall.

11. The revetment block of claim 1, further comprising a plurality of hollow cores or openings extending from the top surface to the bottom surface, and configured to allow foliage to grow through the revetment block, to release hydrostatic pressure, to allow for water flow, or to dissipate energy.

12. The revetment block of claim 1, wherein the top surface is a substantially planar surface, from which the leveling pad extends.

13. The revetment block of claim 1, wherein one or both of the first prism or frustum shape and the second prism or frustum shape comprises a conical shape, or a square, rectangular or pentangular shape.

14. The revetment block of claim 1, wherein a height or thickness of the revetment block is measured between the top and bottom surfaces, and wherein the height or thickness is different adjacent the first and second sidewalls.

15. A revetment block, comprising:

a top surface;

a bottom surface;

a first sidewall extending between the top surface and the bottom surface;

a second sidewall extending between the top surface and the bottom surface; and a horizontal duct extending from the first sidewall to the second sidewall, wherein the horizontal duct is parallel with the bottom surface, and wherein the top surface has a non-parallel relationship with the bottom surface;

a first leveling pad comprising a first prism or frustrum shape having a height extending from the top surface adjacent the first sidewall, wherein the first leveling pad is configured for a second horizontal duct of a second such revetment block stacked on the top surface to be parallel with the first horizontal duct;

a second leveling pad adjacent the first sidewall shape and comprising a second prism or frustrum shape having a same height as the first leveling pad extending from the top surface, wherein the second leveling pad is further configured for the second horizontal duct of the second such revetment block stacked on the top surface to be parallel with the first horizontal duct; and third and fourth leveling pads comprising third and fourth prism or frustrum shapes spaced apart on the top surface adjacent the second sidewall, wherein the third and fourth leveling pads have a different height or different heights than the first leveling pad and the second leveling pad, such that the third and fourth leveling pads are configured for the second horizontal duct of the second such revetment block stacked on the top surface to be parallel with the first horizontal duct;

wherein the top surface is tapered at a constant, positive slope from the first sidewall to the second sidewall.

16. A stack of revetment blocks, comprising:

a first revetment block including a top surface, a bottom surface opposite the top surface, and a first horizontal duct extending from a first sidewall to a second sidewall, wherein the horizontal duct is parallel with the bottom surface, and wherein the top surface has a non-parallel relationship with the bottom surface, a first leveling pad comprising a first prism or frustum shape extending from the top surface adjacent the first sidewall, and a second leveling pad comprising a second prism or frustrum shape extending from the top surface adjacent the second sidewall; and a second revetment block including a top surface, a bottom surface opposite the top surface, and a second horizontal duct extending from a first sidewall of the second revetment block to a second sidewall of the second revetment block, wherein the second revetment block is stacked on the top surface of the first revetment block;

wherein the first and second leveling pads of the first revetment block have a same height extending from the top surface thereof and the height is selected for the second horizontal duct of the second revetment block to be parallel with the first horizontal duct of the first revetment block.

17. The stack of revetment blocks of claim 16, wherein the top surface of the second revetment block has a non-parallel relationship with the bottom surface, wherein the top surface of the second revetment block includes a second set of first and second leveling pads comprising prism or frustum shapes extending from the top surface of the second revetment block adjacent the first sidewall thereof, the stack of revetment blocks further including a third revetment block including a third horizontal duct, wherein the third revetment block is stacked on the top surface of the second revetment block, wherein each of the second set of first and second leveling pads has a same height extending from the top surface of the second revetment block and is configured for the third horizontal duct to be parallel with the first and second horizontal ducts.

18. The stack of revetment blocks of claim 16, wherein the second horizontal duct of the second revetment block stacked on the top surface of the first revetment block is configured for passing of a cable to interlock rows of the first and second revetment blocks to form a revetment mat.

19. The stack of revetment blocks of claim 18, wherein the first revetment block comprises third and fourth leveling pads spaced apart along the top surface and adjacent the second sidewall of the first revetment block, wherein the third and fourth leveling pads have a different height or different heights than the first and second leveling pads and the different height or different heights are selected for the second horizontal duct of the second revetment block stacked on the top surface of the first revetment block to be parallel with the first horizontal duct of the first revetment block.

20. The stack of revetment blocks of claim 18, wherein the first leveling pad and the second leveling pad of the first revetment block are equidistant from an edge of the top surface adjacent the first sidewall of the first revetment block.

21. The stack of revetment blocks of claim 16, wherein the first and second revetment blocks include a concrete material.

22. The stack of revetment blocks of claim 16, wherein the first and second revetment blocks include a dry-cast concrete material.

23. The stack of revetment blocks of claim 16, wherein:

one or both of the first prism or frustum shape and the second prism or frustum shape comprises a conical shape, or a square, rectangular or pentangular shape; or a height or thickness of the first revetment block is measured between the top and bottom surfaces thereof, wherein the height or thickness is different adjacent the first and second sidewalls of the first revetment block.

24. A method of forming a revetment block array, comprising:

contemporaneously placing a first plurality of revetment blocks of a first stack in a first orientation on a surface, wherein each of the first plurality of revetment blocks includes a respective horizontal duct;

wherein each of the first plurality of revetment blocks has a sloped top surface with a pair of leveling pads comprising prism or frustum shapes extending a same height from the sloped top surface adjacent a sidewall thereof, wherein the same height is selected for the horizontal ducts of the first plurality of revetment blocks to be parallel when said revetment blocks are stacked on one another in the first stack, along the respective sloped top surfaces thereof; and after contemporaneously placing the first plurality of revetment blocks of the first stack in the first orientation on the surface, contemporaneously placing a second plurality of such revetment blocks in a second stack with the first orientation and adjacent to and horizontally offset from the first stack such that a horizontal duct of each revetment block of the second plurality of revetment blocks is axially aligned with the horizontal duct of a respective one of the first plurality of revetment blocks and configured to interlock rows of the first and second revetment blocks by cabling.

25. The method of claim 24, further comprising contemporaneously lifting the first plurality of revetment blocks using a lifting implement, wherein the first plurality of revetment blocks are configured for placing in the first stack.

26. The method of claim 25, further comprising contemporaneously lifting the first plurality of revetment blocks via the horizontal duct of at least a bottom one of the first plurality of revetment blocks using the lifting implement, wherein a rod or lifting apparatus is inserted into said horizontal duct.

27. The method of claim 25, further comprising contemporaneously lifting the first plurality of revetment blocks using the lifting implement attached to an electric motor, an air hoist, a pneumatic lifting device, or a hydraulic pump.

28. The method of claim 24, further comprising placing additional stacks of additional pluralities of such revetment blocks contemporaneously with or after placement of the first stack of revetment blocks on the surface.

* * * * *